US011229280B1

(12) United States Patent
Robinson et al.

(10) Patent No.: US 11,229,280 B1
(45) Date of Patent: Jan. 25, 2022

(54) TOOTHBRUSH WITH BRISTLE-MOUNTING SYSTEM FOR RETARDING BRISTLE STRAIN

(71) Applicant: TIFINITY ORAL CARE, LLC, Tucson, AZ (US)

(72) Inventors: Dane Robinson, Glendale, AZ (US); Daniel S. Joseph, Tucson, AZ (US); Walter C. Brauer, Glendale, AZ (US)

( * ) Notice: Subject to any disclaimer, the term of this patent is extended or adjusted under 35 U.S.C. 154(b) by 0 days.

(21) Appl. No.: 16/751,935

(22) Filed: Jan. 24, 2020

Related U.S. Application Data

(63) Continuation of application No. 15/817,197, filed on Nov. 28, 2017, now Pat. No. 10,548,392.

(51) Int. Cl.
*A46B 9/04* (2006.01)
*A46B 5/00* (2006.01)
*A46B 3/08* (2006.01)

(52) U.S. Cl.
CPC ..... *A46B 5/0029* (2013.01); *A46B 3/08* (2013.01); *A46B 9/04* (2013.01); *A46B 2200/1066* (2013.01)

(58) Field of Classification Search
CPC ..... A46B 5/0029; A46B 9/04; A46B 3/00
See application file for complete search history.

(56) References Cited

U.S. PATENT DOCUMENTS 2,882,544 A * 4/1959 Hadidian ..... A46B 7/06 15/167.1
5,802,656 A 9/1998 Dawson
6,036,277 A * 3/2000 Weihrauch ..... A46B 3/20 15/186
6,311,360 B1 * 11/2001 Lanvers ..... A46B 3/16 15/167.1
10,548,392 B2 * 2/2020 Robinson ..... A46B 3/08
2007/0271717 A1 11/2007 Clos et al.
2008/0104785 A1 * 5/2008 Robinson ..... A46B 3/16 15/167.1
2009/0229064 A1 * 9/2009 Robinson ..... A46D 1/055 15/191.1
2010/0088836 A1 4/2010 Kiichhofer et al.

FOREIGN PATENT DOCUMENTS

EP 1201153 A2 5/2002
WO 2000069309 A1 11/2000

* cited by examiner

*Primary Examiner* — Michael D Jennings
(74) *Attorney, Agent, or Firm* — Parsons & Goltry, PLLC; Michael W. Goltry; Robert A. Parsons

(57) ABSTRACT

A toothbrush includes an elongate body having a handle and a head formed with bristle assemblies each including elastic upper and lower boots on either side of an intermediate layer, an elastic collar extends through the intermediate layer from the lower boot to the upper boot, a tuft of bristles bound by a coupling, the tuft of bristles extends from the coupling in the lower boot through the collar and through the upper boot and therebeyond to a brushing extremity, the upper boot provides lateral elastic compliance between the upper boot and the tuft of bristles through the upper boot, the lower boot provides lateral elastic compliance between the lower boot and the coupling in the lower boot, and the intermediate layer pinches the collar against the tuft of bristles through the collar elastically retaining the tuft of bristles through the elastic collar to the elastic collar.

11 Claims, 7 Drawing Sheets

TOOTHBRUSH WITH BRISTLE-MOUNTING SYSTEM FOR RETARDING BRISTLE STRAIN

FIELD OF THE INVENTION

The present invention relates generally to toothbrushes and, more particularly, bristle-mounting systems designed to relieve bristle strain to extend bristle life.

BACKGROUND OF THE INVENTION

Toothbrushes are well known and commonly employed to maintain dental hygiene. Toothbrushes are routinely used daily or more often to brush teeth to remove food particles, plaque, and other debris from around the teeth and gums. Most dental hygiene professionals recommend brushing the teeth by moving the toothbrush in a reciprocal lateral direction with the toothbrush held in a general horizontal position during brushing to facilitate safe and efficient cleaning of the teeth and gums.

A standard toothbrush includes bristles mounted in a head. The head provides support for the bristles. The bristles are mounted on the toothbrush in an upright orientation to enable the brushing ends of the bristles to engage the teeth when the toothbrush is used to brush teeth. During the use of a toothbrush, the bristles inherently bend repeatedly. Following prolonged use, the repeated bending of the bristles causes the bristles to splay permanently outwards from the upward orientation and can cause some of the bristles to break where they bend at their attachment point to the head reducing bristle density, whereupon the toothbrush is discarded and replaced.

In the United States alone it is estimated that nearly a billion toothbrushes, representing more than 50 million pounds of waste, are discarded and end up in land fills every year. These toothbrushes are made from a combination of plastic, rubber, nylon, and a combination of plastic and cardboard for the packaging. These materials are largely not biodegradable. Therefore, they remain in landfills indefinitely. Furthermore, discarded toothbrushes often end up in the oceans, washed up on our beaches, or consumed by marine life. Accordingly, there is a need in the art for a toothbrush having a bristle-mounting system that retards bristle bending relative to the head for retarding bristle strain and breakage for prolonging bristle competency and bristle life for, in turn, prolonging the useful life of the toothbrush for reducing the adverse environmental impacts that discarded toothbrushes inflict on the environment.

SUMMARY OF THE INVENTION

According to the principle of the invention, a toothbrush includes an elongate body including a handle and a head formed with bristle assemblies. The bristle assemblies each include an upper elastic boot, a lower elastic boot, an elastic collar, an intermediate layer, and a tuft of bristles bound by a coupling. The upper elastic boot and the lower elastic boot are formed on either side of the intermediate layer. The elastic collar extends through the intermediate layer from the lower elastic boot to the upper elastic boot. The coupling is in the lower elastic boot. The tuft of bristles extends from the coupling in the lower elastic boot through the elastic collar and through the upper elastic boot and beyond the upper elastic boot to a brushing extremity. The upper elastic boot provides lateral elastic compliance between the upper elastic boot and the tuft of bristles through the upper elastic boot, the lower elastic boot provides lateral elastic compliance between the lower elastic boot and the coupling in the lower elastic boot, and the intermediate layer pinches the elastic collar against the tuft of bristles through the elastic collar elastically and pivotally retaining to the elastic collar the tuft of bristles through the elastic collar. The intermediate layer is formed with an inwardly-directed continuous edge against and surrounding the elastic collar between the upper elastic boot and the lower elastic boot, and is sufficiently rigid along a plane perpendicular relative to the elastic collar and the tuft of bristles through elastic collar to enable the inwardly-directed continuous edge to pinch the elastic collar against the tuft of bristles through the elastic collar. The upper elastic boot surrounds the tuft of bristles extending through the upper elastic boot. The lower elastic boot surrounds the coupling. The coupling is enclosed in the lower elastic boot. The upper elastic boot, the lower elastic boot, and the elastic collar are coaxial. The upper elastic boot, the lower elastic boot, and the elastic collar are integral to form a unitary elastic body.

BRIEF DESCRIPTION OF THE DRAWINGS

Referring to the drawings.

DETAILED DESCRIPTION

Figure 1:
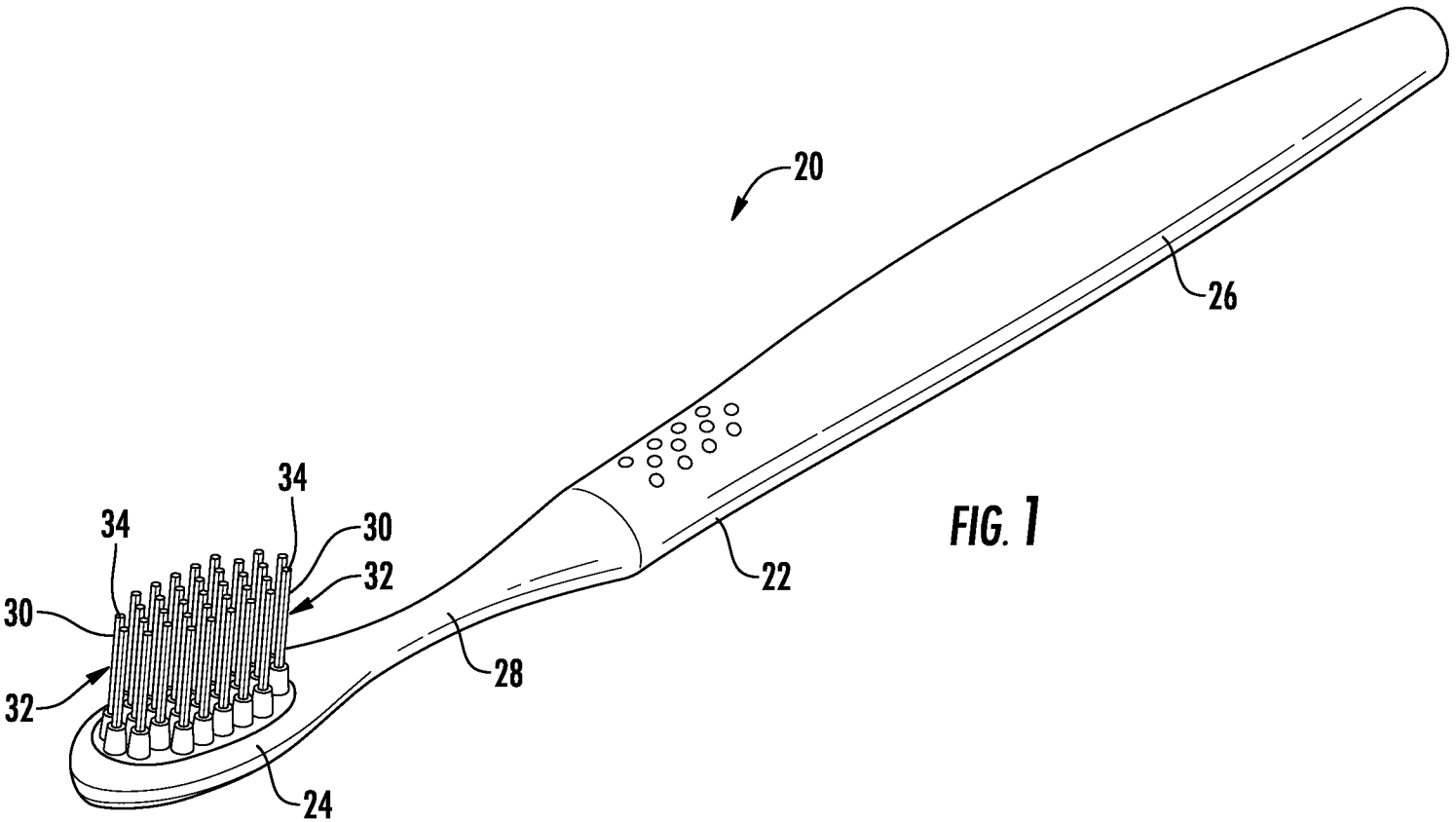
FIG. 1 is a perspective view of a toothbrush constructed and arranged in accordance with the principle of the invention, the toothbrush includes an elongate body having a handle and a head formed with bristle assemblies.
Figure 2:
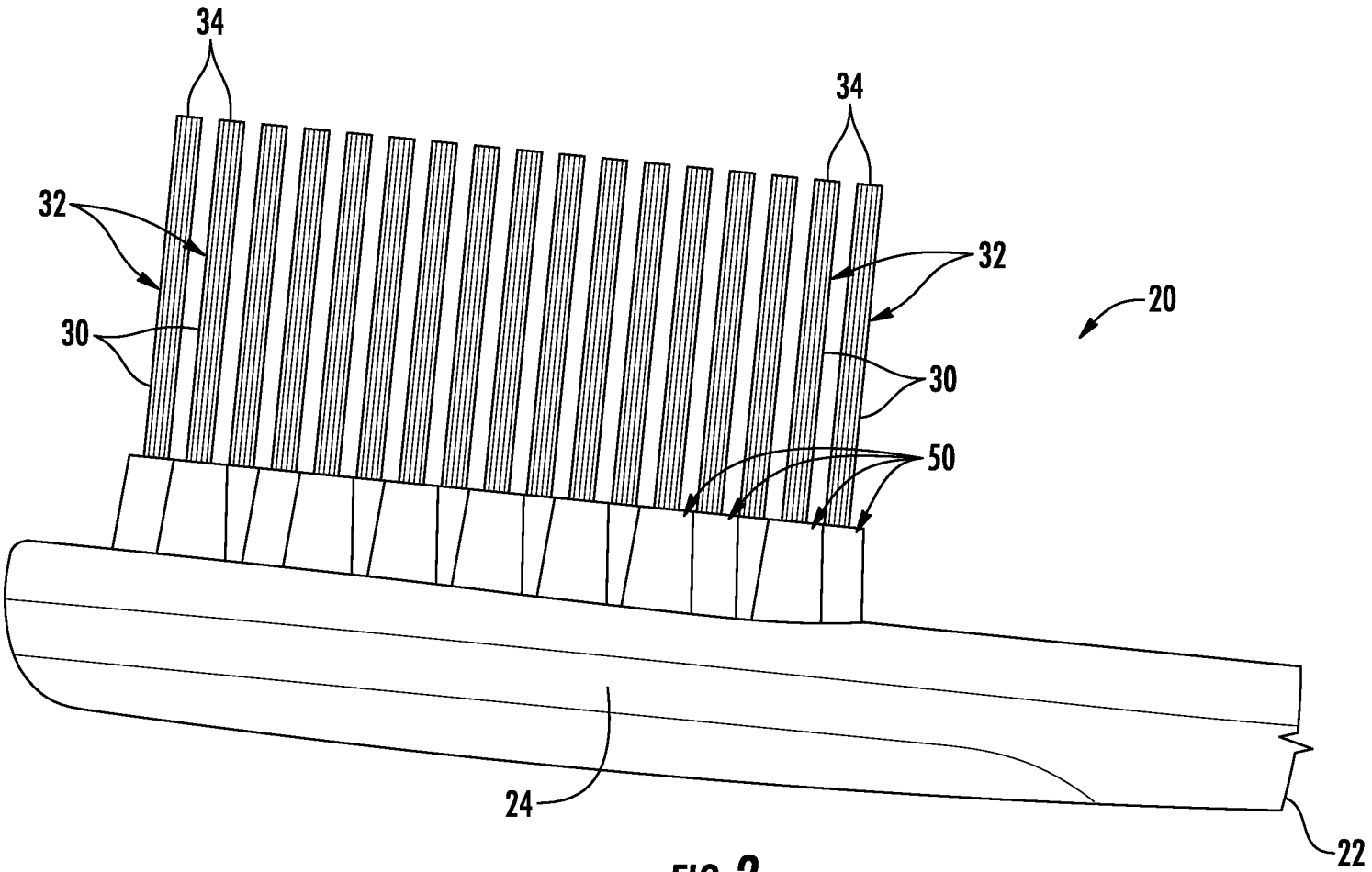
FIG. 2 is an enlarged side elevation view of the head of the toothbrush of FIG. 1.

Turning now to the drawings, in which like reference characters indicate corresponding elements throughout the several views, attention is first directed to FIG. 1 illustrating toothbrush 20 including elongate body 22 having head 24 and handle 26, and neck 28 therebetween. Elongate body 22 is fashioned of plastic, rubber, a combination thereof, or other similar material or combination of materials common in the art. With additional reference to FIGS. 2 and 3, head 24 supports bristles 30. Bristles 30 are arranged in a cluster of tufts 32 of bristles 30, i.e. bristle tufts 32. Bristle tufts 32 are mounted on head 24 in an upright orientation to enable brushing ends or extremities 34 of the tufts 30 to engage the teeth when toothbrush 20 is used to brush teeth. Bristle tufts 32 are circular in cross section in this example.

Figure 3:
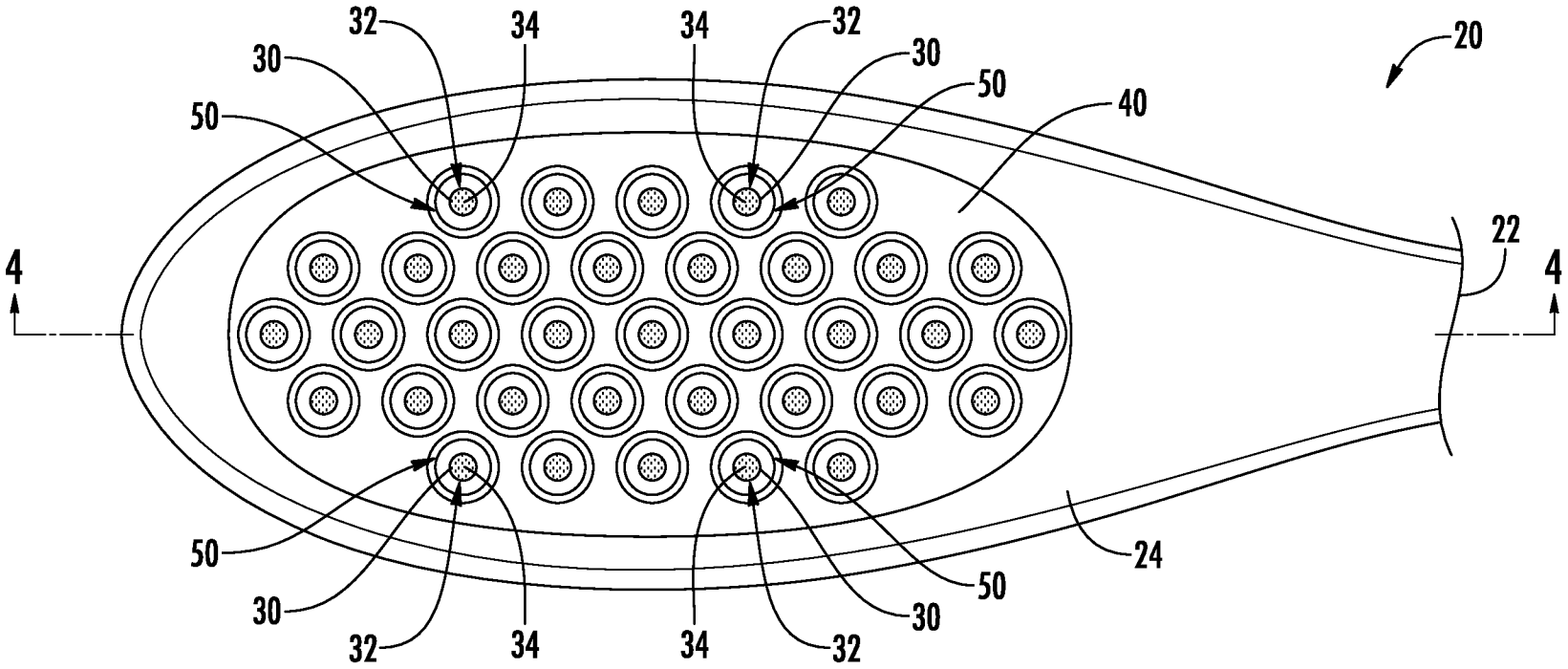
FIG. 3 is a top plan view corresponding to FIG. 2.
Figure 4:
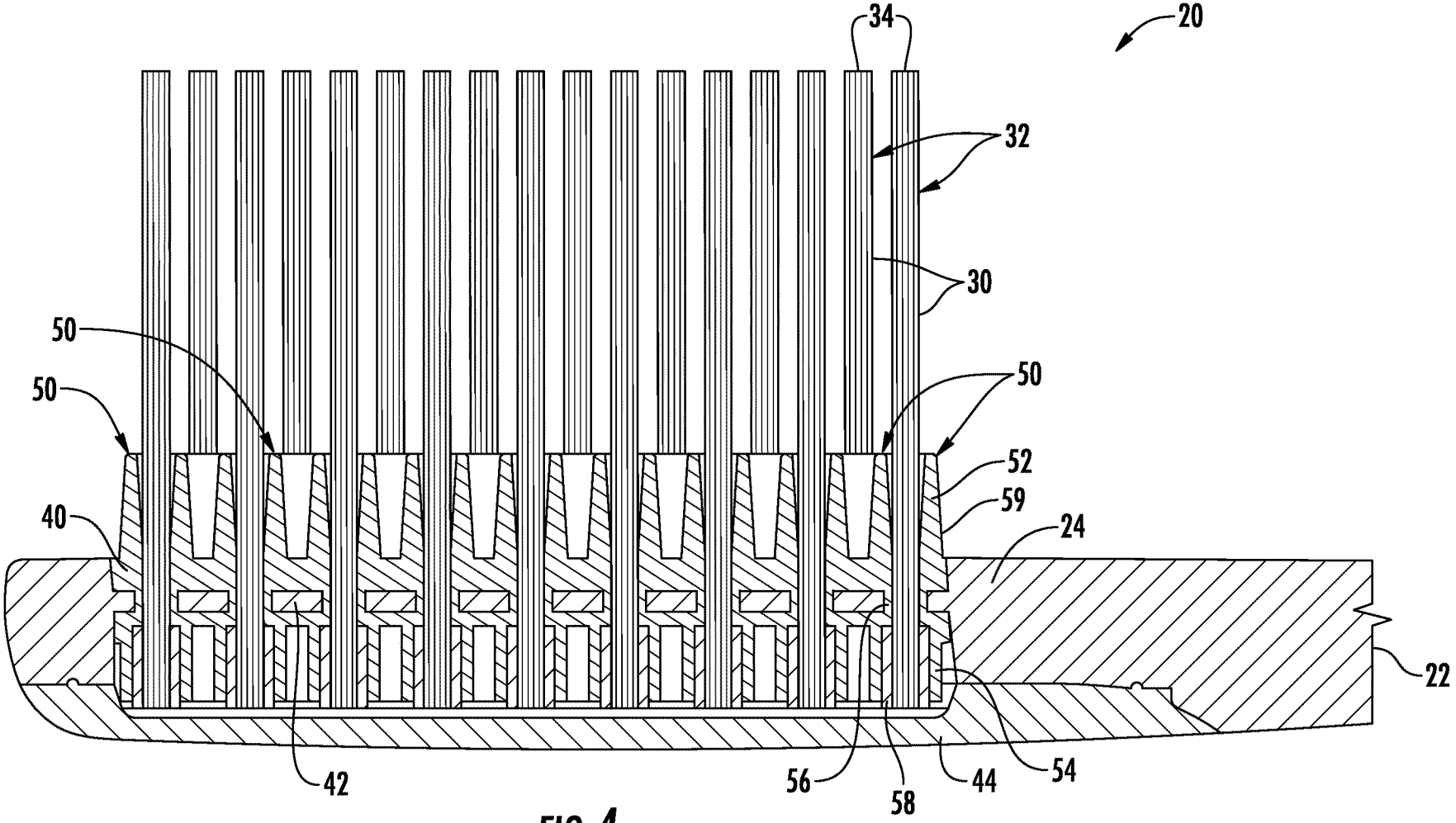
FIG. 4 is a section view taken along line 4-4 of FIG. 4 illustrating the bristle assemblies.

In FIG. 4, which is a section view taken along line 4-4 of FIG. 3, head 24 includes block 40 formed around internal frame or layer 42, which together support bristle tufts 32. Layer 24 is integral with head 24, and block 40 encapsulates layer 42. Block 40 is formed of an elastic material having inherent elastic properties of resilience and shape memory being inherently capable of returning to its original shape after being flexed or otherwise deformed when toothbrush 20 is used to brush teeth. The resilient material of block 40 is an elastomer, such as RTP 2700S-30A thermoplastic elastomer. Block 40 is molded over and around layer 42. Cap 44 under block 40 and layer 42 defines the underside of head 24. Cap 44 is part of head 24. Cap 44, formed of plastic or rubber, is affixed in place via adhesive or heat bonding, and can be overmolded onto, or formed integrally with, head 24 in alternate embodiments.

Each bristle tuft 32 and its assemblage with block 40 and layer 42 define a bristle assembly 50. The bristle assemblies 50 are identical in every respect, operate identically to one another, and operate independently from one another. Accordingly, the details of one bristle assembly 50 of toothbrush 20 will now be discussed in detail, with the understanding that the ensuing discussion applies equally to each of the bristle assemblies 50.

Figure 5:
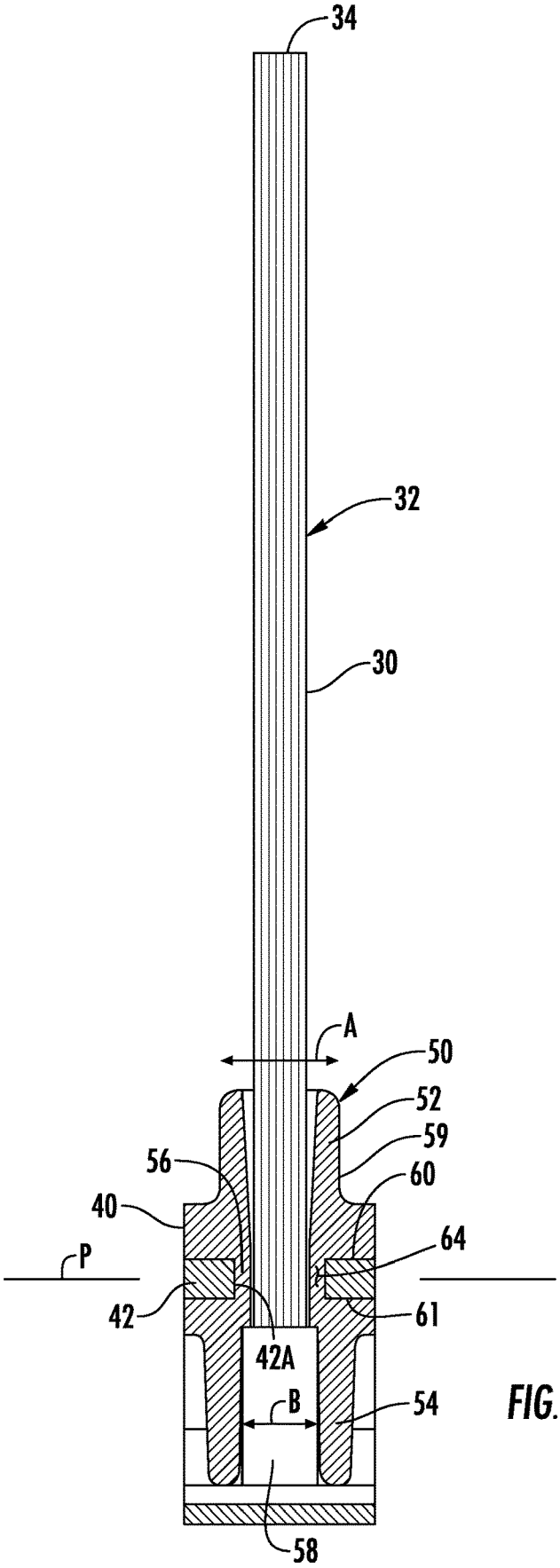
FIG. 5 is an enlarged section view corresponding to FIG. 4 illustrating one of the bristle assemblies as it would appear in an at-rest position.

In FIG. 5, bristle assembly 50, a bristle-mounting system, includes layer 42, boots 52 and 54, collar 56, and tuft 32 of bristles 30 bound by coupling 58, which in this example is a collar of metal crimped around the lower ends of bristles 30. Boots 52 and 54 and collar are parts block 40, are integral with block 40, and are each, therefore, inherently elastic. Boot 52 is an upper boot, and boot 54 is a lower boot. Layer 42 includes upper surface 60, lower surface 62, and opening 64. Opening 64 extends through layer 42 from upper surface 60 to lower surface 62.

Bristles 30 are made of a material that is inherently resilient and flexible. In an illustrative embodiment, bristles 30 are made of a metal or metal alloy, as described in U.S. Pat. No. 6,442,785, the entire contents of which are incorporated herein by reference. Alloy bristles are flexible, resilient, hydrophobic, and can reach deeper. A preferred alloy exhibits inherent superelasticity at temperature ranges experienced under typical use of a toothbrush, such as NiTi alloy including 55.6% Ni and 44.4% Ti. In an alternate embodiment, bristles 30 can be fashioned of nylon or other material or combination of material commonly used in standard toothbrushes.

Upper boot 52 and lower boot 54 are on either side of layer 42 and opening 64, are integral with bock 40 formed around layer 42, and are carried or otherwise supported by layer 42. Upper boot 42, a circular, elongate collar, extends upright from upper surface 60 of layer 42, and lower boot 54, also a circular, elongate collar, extends downwardly from lower surface 62 of layer 42. Upper boot 52, lower boot 54, and collar 56 are integral to form a unitary elastic body 59. Collar 56, integral with upper and lower boots 52 and 54, extends through opening 64 of layer 42 from lower boot 54 to upper boot 52. Upper boot 52, lower boot 54, collar 56, and opening 64 are coaxial.

Coupling 58 is in lower boot 54, and is enclosed in lower boot 54 in head 24. Tuft 32 of bristles 30 extends from coupling 58 in lower boot 54 through collar 56 and through upper boot 52 and beyond upper boot 52 to brushing extremity 34. Upper boot 52 surrounds tuft 32 of bristles 30 extending through upper boot 54. Lower boot 54 surrounds coupling 58. Upper boot 52, being elastic, provides lateral or sideways elastic compliance between upper boot 52 and tuft 32 of bristles 30 through upper boot 52. Lower boot 54, also being elastic, provides lateral or sideways elastic compliance between lower boot 54 and coupling 58 in lower boot 54. Coupling 56 is in lower boot 54 under opening 64 of layer 42, and cap 44 under coupling 56 and lower boot 54 encloses coupling 56 in lower boot 54 of head 24.

Layer 42 pinches collar 56 against tuft 32 of bristles 30 through collar 56 elastically and pivotally retaining tuft 32 of bristles 30 through collar 56 to collar 56, according to the principle of the invention. Layer 42 is formed with inwardly-directed continuous edge 42A that defines opening 64. Edge 42A is against and surrounds collar 56 between upper boot 52 and lower boot 54. Layer 42 resides along plane P that is perpendicular relative to collar 56. Layer 42 is integral with head 24 and is sufficiently rigid along plane P that is perpendicular relative to collar 56 and to tuft 32 of bristles 30 through collar 56 when tuft 32 of bristles 30 are at rest in FIG. 5 to enable edge 42A to pinch collar 56, which is elastic, against tuft 32 of bristles 30 through collar 30 to captively retain tuft 32 of bristles 30 through collar 56 to collar 56 while at the same time enabling tuft 32 of bristles 30 through collar 56 to deform collar 56 and displace pivotally relative to opening 64 and to layer 42 when tuft 32 of bristles 30 flexes from an at-rest position in FIG. 5 to flexed positions, such as in FIGS. 6 and 7. Tuft 32 of bristles 30 is in the at rest position when bristles 30 of tuft 32 are free from the influence of brushing, such as when toothbrush 20 is at rest and not in use. Layer 42 is formed of plastic or other material or combination of materials having the inherent properties of rigidity and resilience. Bristle assemblies 50 of toothbrush 20 share layer 42.

Upper and lower boots 52 and 54 work independently from one another with respect to tuft 32 of bristles 30 and coupling 56, respectively. As for upper boot 52, upper boot 52 receives thereagainst tuft 32 of bristles 30 through upper boot 52 when tuft 32 of bristles 30 flex from the at-rest position in FIG. 5 to an initially flexed in FIG. 6, and deflects laterally or otherwise to the side by tuft 32 of bristles 30 through upper boot 52 in FIG. 7 when tuft 32 of bristles 30 flex beyond the initially flexed position in FIG. 6. Tuft 32 of bristles 30 flex from side-to-side in the directions of double arrowed line A in FIG. 5 when toothbrush is used for brushing, at the same time causing upper boot 52 to elastically flex from side-to-side also in the directions of double arrowed line A in FIG. 5. Lower boot 54 is flexed by coupling 58 laterally or otherwise to the side in FIGS. 6 and 7 when tuft 32 of bristles 30 flex from the at-rest position in FIG. 5. Coupling 58 displaces from side-to-side in the directions of double arrowed line B in FIG. 5 when toothbrush is used for brushing, at the same time causing lower boot 52 to elastically flex from side-to-side also in the directions of double arrowed line B in FIG. 5.

Again, tuft 32 of bristles 30 is in the at rest position when bristles 30 of tuft 32 are free from the influence of brushing, such as when toothbrush 20 is at rest and not in use. Upper boot 52, lower boot 54, and collar 54 resume their original shapes when tuft 32 of bristles 30 is free from the influence of brushing, and elastically reset tuft 32 of bristles 30 to the at-rest position in FIG. 5. When tuft 32 of bristles 30 displaces laterally from side-to-side in the directions of double arrowed line A in FIG. 5, tuft 32 of bristles 30 through collar 56 acts on collar 56 causing collar 56 to elastically displace for providing pivotal movement of tuft 32 of bristles 30 through collar 56 relative to opening 64 and layer 42. When tuft 32 of bristles 30 displace laterally to one side, upper boot 52 displaces elastically to one side by tuft 32 of bristles 30 through upper boot 52, and lower boot 54 displaces elastically to the opposite side by coupling 56 in lower boot 54. Accordingly, collar 56 displaces elastically enabling pivoting of tuft 32 of bristles 30 through collar, and upper and lower boots 52 and 54 displace elastically from side-to-side in opposite directions, upper boot 52 by tuft 32 of bristles 30 through upper boot 52 and lower boot 54 by coupling 58 in lower boot 54, during brushing. Because tuft 32 of bristles 30 pivot relative to collar 56 as enabled by the inherent elasticity of collar 56, bending of bristles 30 of tuft 32 of bristles 30 through collar 56 is inherently suppressed compared to if tuft 32 of bristles 30 was rigidly retained, thereby inherently extending the life of bristles 30, in accordance with the principle of the invention.

Figure 6:
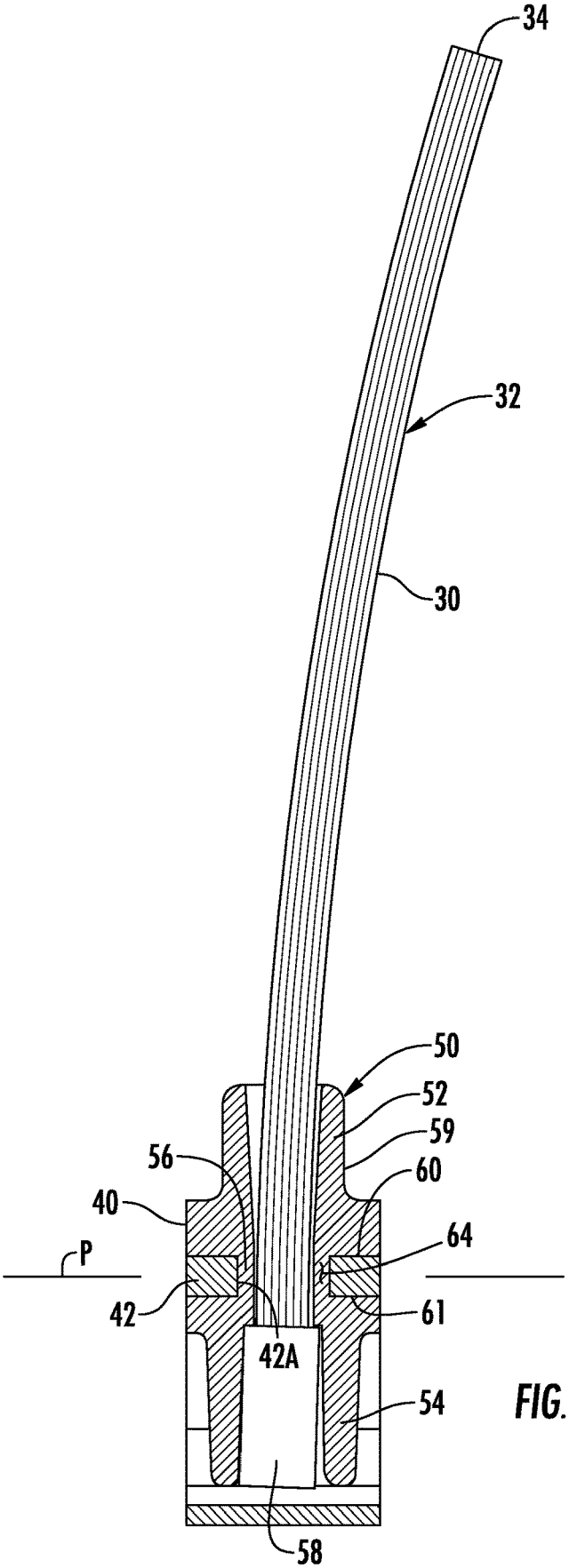
FIGS. 6 and 7 are view corresponding to FIG. 5 illustrating the bristle assembly as it would appear initially flexed in FIG. 6 from the at at-rest position in FIG. 5, and flexed in FIG. 7 beyond the initially flexed position in FIG. 6.
Figure 7:
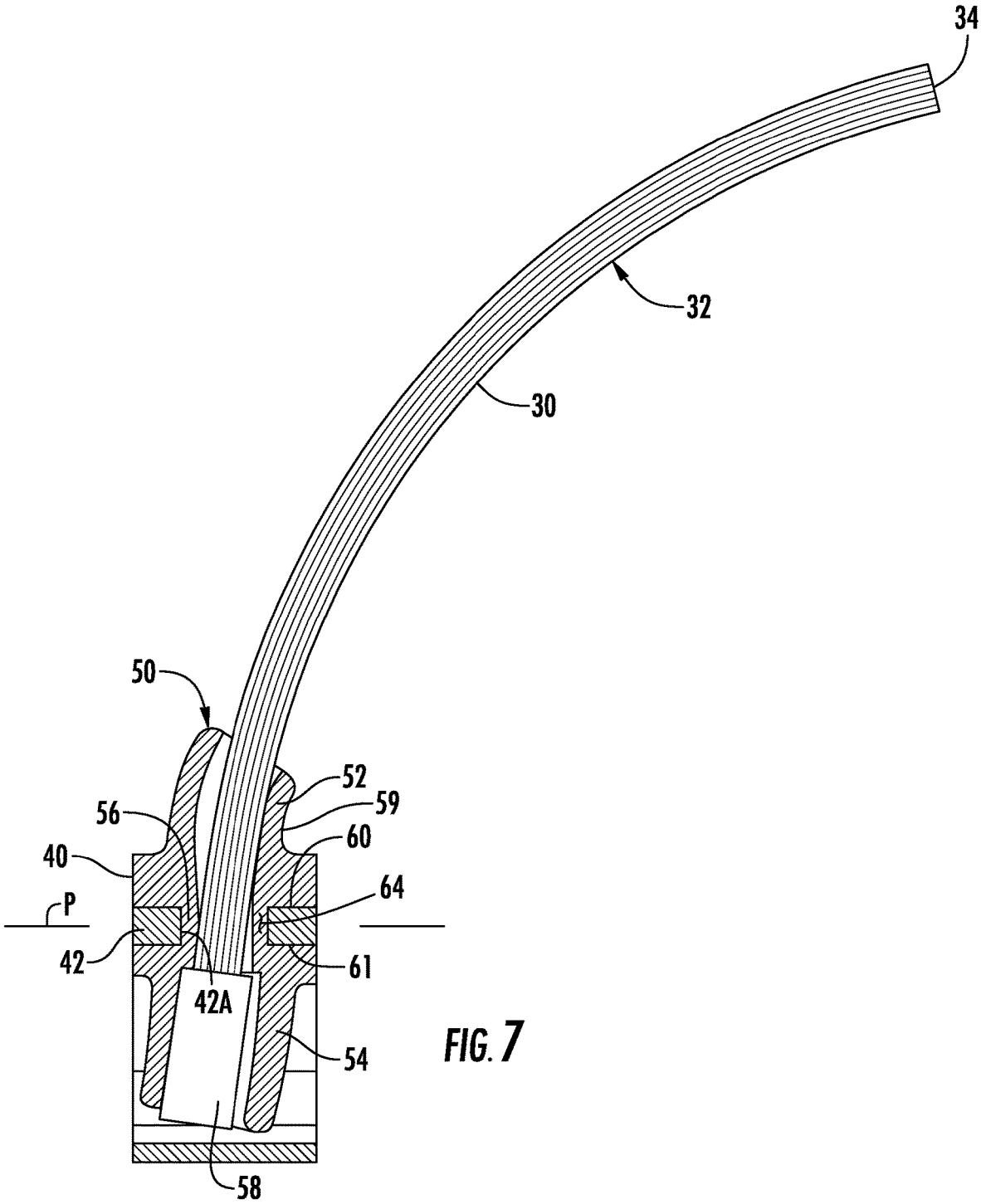

Accordingly, collar 56 deforms elastically by tuft 32 of bristles 30 displacing pivotally therein, upper boot 52 deforms elastically side-to-side in the directions of double arrowed line A in FIG. 5 by tuft 32 of bristles 30 through upper boot 52, and lower boot 54 deforms elastically side-to-side in the directions of double arrowed line B in FIG. 5 by coupling 58 in lower boot 54, when tuft 32 of bristles 30 flex in FIGS. 6 and 7 from the at-rest position in FIG. 5. Upper boot 52 reinforces bristles 30 of tuft 32 of bristles 30 through upper boot, when upper boot 52 is elastically flexed/deflected by and against tuft 32 of bristles 30 through upper boot 52. Lower boot 54 reinforces coupling 58 in lower boot 54, when lower boot 54 is elastically flexed/deflected by and against coupling 58 in lower boot 54. Because upper boot 52 and lower boot 54 elastically flex/displace from side to side in opposite directions when tuft 32 of bristles 30 from side-to-side, the resulting counterforces exerted by upper boot 52 against tuft 32 of bristles 30 through upper boot 52 and by lower boot 54 against coupling 58 in lower boot 54 inherently reinforce bristle assembly 50.

Collar 56 resumes its original or at-rest shape in FIG. 5 and in so doing acts on tuft 32 of bristles 30 through collar 56, upper boot 52 resumes its original or at-rest shape in FIG. 5 and in so doing acts on tuft 32 of bristles 30 through upper boot 52, and lower boot 54 resumes its original or at-rest shape in FIG. 5 and in so doing acts on coupling 58 in lower boot 54, thereby resetting tuft 32 of bristles to its at rest position in FIG. 5 when tuft 32 of bristles 30 are free from the influence of brushing. Because collar 56 deforms elastically side-to-side by tuft 32 of bristles 30 through collar 56, upper boot 52 deforms elastically side-to-side by tuft 32 of bristles 30 through upper boot 52, and lower boot 54 deforms elastically side-to-side by coupling 58 in lower boot 54, when tuft 32 of bristles 30 flex between flexed (FIGS. 6 and 7) and unflexed (FIG. 5) positions inherently retarding bristles 30 from bending, straining and breaking at their connection point to collar 56, which extends bristle 30 life and, accordingly, the useful life of toothbrush 20.

In sum, toothbrush 20 includes elongate body 22 including handle 26 and head 24 formed with bristle assemblies 50. Each bristle assembly 50 includes upper elastic boot 52, lower elastic boot 54, elastic collar 56, intermediate layer 42, and tuft 32 of bristles 30 bound by coupling 58. Upper elastic boot 52 and lower elastic boot 54 are formed on either side of intermediate layer 42. Elastic collar 56 extends through intermediate layer 42, through opening 64 of intermediate layer 42, from lower elastic boot 54 to upper elastic boot 52. Coupling 58 is in lower elastic boot 54. Tuft 32 of bristles 30 extends from coupling 58 in lower elastic boot 54 through elastic collar 56 and through upper elastic boot 52 and beyond upper elastic boot 52 to brushing extremity 34. Upper elastic boot 52 provides lateral or side-to-side elastic compliance between upper elastic boot 52 and tuft 32 of bristles 30 through upper elastic boot 54, lower elastic boot 54 provides lateral or side-to-side elastic compliance between lower elastic boot 54 and coupling 58 in lower elastic boot 54, and intermediate layer 54 pinches elastic collar 56 against tuft 32 of bristles 30 through elastic collar 56 elastically and pivotally retaining to elastic collar 56 to tuft 32 of bristles 30 through elastic collar 56. Intermediate layer 42 is formed with inwardly-directed continuous edge 42A that defines opening 64 and that is against and surrounds elastic collar 56 between upper elastic boot 52 and lower elastic boot 54, and is sufficiently rigid along plane P perpendicular relative to elastic collar 56 and tuft 32 of bristles 30 through elastic collar 56 to enable inwardly-directed continuous edge 42A to pinch elastic collar 56 against tuft 32 of bristles 30 through elastic collar 56. Upper elastic boot 52 surrounds tuft 32 of bristles 30 extending through upper elastic boot 52. Lower elastic boot 54 surrounds coupling 58. Coupling 58 is enclosed in lower elastic boot 54. Upper elastic boot 52, lower elastic boot 54, and elastic collar 56 are coaxial. Upper elastic boot 52, lower elastic boot 54, and elastic collar 56 are integral to form unitary elastic body 59, which is a sub-body or sub-part of block 40.

The present invention is described above with reference to illustrative embodiments. However, those skilled in the art will recognize that changes and modifications may be made in the described embodiments without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A toothbrush comprising an elongate body including a handle and a head formed with bristle assemblies each comprising an elastic collar extending through a layer, a tuft of bristles extending through the elastic collar to a brushing extremity, the layer pinching the elastic collar against the tuft of bristles the elastic collar elastically and pivotally retaining the tuft of bristles to the head, and the layer formed with an inwardly-directed continuous edge against and surrounding the elastic collar and sufficiently rigid along a plane perpendicular relative to the elastic collar and the tuft of bristles to enable the inwardly-directed continuous edge to pinch the elastic collar against the tuft of bristles.

2. A toothbrush comprising an elongate body including a handle and a head formed with bristle assemblies each comprising an elastic boot and a coupling formed on either side of a layer, an elastic collar extending through the layer to the elastic boot, a tuft of bristles bound by the coupling, the tuft of bristles extending from the coupling through the elastic collar and through the elastic boot to a brushing extremity, the elastic boot providing lateral elastic compliance for the tuft of bristles through the elastic boot, the layer pinching the elastic collar against the tuft of bristles, and the elastic collar elastically and pivotally retaining the tuft of bristles to the head.

3. The toothbrush according to claim 2, wherein the layer is formed with an inwardly-directed continuous edge against and surrounding the elastic collar, and is sufficiently rigid along a plane perpendicular relative to the elastic collar and the tuft of bristles through elastic collar to enable the inwardly-directed continuous edge to pinch the elastic collar against the tuft of bristles through the elastic collar.

4. The toothbrush according to claim 2, wherein the elastic boot surrounds the tuft of bristles extending through the elastic boot.

5. The toothbrush according to claim 2, wherein the elastic boot and the elastic collar are integral to form a unitary elastic body.

6. A toothbrush comprising an elongate body including a handle and a head formed with bristle assemblies each comprising an elastic boot and a coupling formed on a side of a layer, an elastic collar extending through the layer from the elastic boot, a tuft of bristles bound by the coupling in the elastic boot, the tuft of bristles extending from the coupling in the elastic boot and through the elastic collar to a brushing extremity, the elastic boot providing lateral elastic compliance for the coupling, the layer pinching the elastic collar against the tuft of bristles, and the elastic collar elastically and pivotally retaining the tuft of bristles to the head.

7. The toothbrush according to claim 6, wherein the layer is formed with an inwardly-directed continuous edge against and surrounding the elastic collar and is sufficiently rigid along a plane perpendicular relative to the elastic collar and the tuft of bristles to enable the inwardly-directed continuous edge to pinch the elastic collar against the tuft of bristles through the elastic collar.

8. The toothbrush according to claim 6, wherein the elastic boot surrounds the coupling.

9. The toothbrush according to claim 6, wherein the coupling is enclosed in the lower elastic boot.

10. The toothbrush according to claim 6, wherein the elastic boot and the elastic collar are integral to form a unitary elastic body.

11. A toothbrush comprising an elongate body including a handle and a head formed with bristle assemblies each comprising an elastic collar extending through an opening extending through a layer from a lower surface of the layer to an upper surface of the layer, a tuft of bristles extending through the opening and the elastic collar from under the lower surface to a brushing extremity beyond the upper surface, the layer pinching the elastic collar against the tuft of bristles, the elastic collar elastically and pivotally retaining the tuft of bristles to the head, and the layer formed with an inwardly-directed continuous edge against and surrounding the elastic collar and sufficiently rigid along a plane perpendicular relative to the elastic collar and the tuft of bristles to enable the inwardly-directed continuous edge to pinch the elastic collar against the tuft of bristles.

* * * * *